US011124280B2

(12) United States Patent
Grundmann

(10) Patent No.: US 11,124,280 B2
(45) Date of Patent: Sep. 21, 2021

(54) MAGNETIC COMPENSATION DEVICE FOR A DRONE

(71) Applicant: Siemens Aktiengesellschaft, München (DE)

(72) Inventor: Jörn Grundmann, Großenseebach (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/633,435

(22) PCT Filed: Jul. 9, 2018

(86) PCT No.: PCT/EP2018/068472
§ 371 (c)(1),
(2) Date: Jan. 23, 2020

(87) PCT Pub. No.: WO2019/020347
PCT Pub. Date: Jan. 31, 2019

(65) Prior Publication Data

US 2020/0223520 A1 Jul. 16, 2020

(30) Foreign Application Priority Data

Jul. 27, 2017 (DE) ..... 10 2017 212 936.0

(51) Int. Cl.
*B63G 9/06* (2006.01)
*B63G 7/06* (2006.01)
(Continued)

(52) U.S. Cl.
CPC ..... *B63G 9/06* (2013.01); *B63G 7/06* (2013.01); *H01F 7/20* (2013.01); *H01F 27/24* (2013.01); *H01F 27/28* (2013.01)

(58) Field of Classification Search
CPC ... B63G 7/00; B63G 7/02; B63G 7/06; B63G 9/00; B63G 9/06; B63B 21/00;
(Continued)

(56) References Cited

U.S. PATENT DOCUMENTS 4,350,379 A 9/1982 Peroutky ..... 294/65.5
4,544,985 A 10/1985 Metz et al. ..... 361/144
(Continued)

FOREIGN PATENT DOCUMENTS

AU 2018/305771 A1 11/2019 ..... B63G 7/02
DE 32 12 465 A1 10/1983 ..... B23Q 7/04
(Continued)

OTHER PUBLICATIONS

German Office Action, Application No. 10 2017 212 936.0, 8 pages, dated Jun. 4, 2018.
(Continued)

*Primary Examiner* — Lars A Olson
(74) *Attorney, Agent, or Firm* — Slayden Grubert Beard PLLC

(57) ABSTRACT

Various embodiments include a magnetic compensation device for a drone for triggering mines comprising: a flux-guiding element comprising a soft magnetic material in the shape of an open or closed ring; a receiving chamber for the drone for holding the drone; and an electric coil device coupled magnetically to the flux-guiding element so a predetermined magnetic flux can be coupled into the flux-guiding element using the coil device. The flux-guiding element and the receiving chamber are arranged in relation to one another so that a magnetic flux brought about by the drone can be closed through the ring shape of the flux-guiding element.

17 Claims, 4 Drawing Sheets

(51) Int. Cl.
*H01F 7/20* (2006.01)
*H01F 27/24* (2006.01)
*H01F 27/28* (2006.01)

(58) Field of Classification Search
CPC ... H01F 13/00; H01F 7/00; H01F 7/20; H01F 27/24; H01F 27/28; H01F 38/00; G05F 7/00; F41H 11/146
USPC ..... 114/312; 361/143
See application file for complete search history.

(56) References Cited

U.S. PATENT DOCUMENTS

| | | | | |
|---|---|---|---|---|
| 4,562,789 | A * | 1/1986 | Bornhofft | B63G 7/06 114/312 |
| 4,788,502 | A | 11/1988 | Keller et al. | 324/318 |
| 4,985,678 | A | 1/1991 | Gangarosa et al. | 324/318 |
| 6,798,632 | B1 * | 9/2004 | Holmes | B63G 9/06 361/143 |
| 2002/0195977 | A1 | 12/2002 | Goto | 315/368.25 |

FOREIGN PATENT DOCUMENTS

| | | | | |
|---|---|---|---|---|
| DE | 33 16 005 | A1 | 11/1984 | B63G 7/06 |
| EP | 0 257 371 | A2 | 3/1988 | A61B 10/00 |
| KR | 20120061723 | A | 6/2012 | B66C 1/06 |
| KR | 101404123 | B1 | 6/2014 | B63G 7/08 |
| WO | 2019/020347 | A1 | 1/2019 | B63G 7/02 |

OTHER PUBLICATIONS

International Search Report and Written Opinion, Application No. PCT/EP2018/068472, 22 pages, dated Jan. 7, 2019.
Korean Office Action, Application No. 1020207005391, 6 pages.

* cited by examiner

MAGNETIC COMPENSATION DEVICE FOR A DRONE

CROSS-REFERENCE TO RELATED APPLICATIONS

This application is a U.S. National Stage Application of International Application No. PCT/EP2018/068472 filed Jul. 9, 2018, which designates the United States of America, and claims priority to DE Application No. 10 2017 212 936.0 filed Jul. 27, 2017, the contents of which are hereby incorporated by reference in their entirety.

TECHNICAL FIELD

The present disclosure relates to drones. Various embodiments may include magnetic compensation devices for a drone for triggering mines and/or methods for changing the temporary compensation for the magnetic field of a drone by means of such a device.

BACKGROUND

With known systems for remote clearance of underwater mines unmanned drones, which are equipped with magnetic coils or with permanent magnets for triggering of magnetic mines, are employed. These coils or permanent magnets create strong magnetic fields, which can cause the underwater mines to detonate. In such cases the drones are designed so that they do not sustain any damage at the typical distance for triggering the mines.

Such drones can have their own propulsion system, for example the German navy has "Seehund" (seal) type remotely-operated vehicles that are equipped with a diesel engine. The magnet system for triggering the mines in this case is integrated here into the stern of the remotely-operated vehicles. As well as such drones moving on the surface, underwater drones for mine clearance are also known, which either have their own drive or can be towed by other (submersible) vehicles.

A primary disadvantage of the known mine-clearance drones with magnetic coils is that the great weight of the magnetic coils needed for strong magnetic fields means that such drones are very heavy and mostly also relatively large. Thus, it is relatively expensive to transport such drones to different locations where they are to be deployed, in particular transporting them by air is rendered significantly more difficult by their great weight. When normally-conducting magnetic coils are used a permanent supply of energy is additionally needed, which also contributes to the weight. For drones with their own drive the drive motor additionally contributes to the great weight and volume. Furthermore, a supply of energy is also needed in addition for the drive, for example in the form of fuel for a diesel motor or also in the form of electrically-stored energy for an electric motor.

Mine-clearance drones with permanent magnets instead of magnetic coils can be designed under some circumstances with a comparatively low weight and are then correspondingly lighter to transport. Moreover, they are comparatively robust. A disadvantage of drones with permanent magnets however is that the strong magnetic field cannot be switched-off for such transport. Because of the problem of electromagnetic interference such drones have therefore not previously been transported by air. Transport by air would be very advantageous in many cases however, so as to be able to move a drone to its desired deployment location as quickly as possible.

SUMMARY

The teachings of the present disclosure describe magnetic compensation devices for a drone for triggering mines, with which the magnetic field of such a drone can be at least compensated for in part for transporting it. For example, some embodiments include a magnetic compensation device (21) for a drone (1) for triggering mines, comprising at least one flux-guiding element (23) made of a soft magnetic material, which has the structure of an open or closed ring, a receiving chamber (25) for the drone (1), in which said drone can be held, and at least one electric coil device (31), which is coupled magnetically to the flux-guiding element (23) in such a way that a predetermined magnetic flux (39) can be coupled into the flux-guiding element (23) with the coil device (31), wherein the flux-guiding element (23) and the receiving chamber (25) are arranged in relation to one another so that a magnetic flux (37) brought about by the drone (1) can be closed in the form of a ring in the flux-guiding element (23).

In some embodiments, there is at least one sensor unit (41), by means of which a physical characteristic, which depends on the relative position of flux-guiding element (23) and drone (1), can be measured, and a regulation device (45), by means of which a current fed into the electric coil device (31) can be regulated as a function of the measured size of the physical characteristic.

In some embodiments, the at least one flux-guiding element (23) has the structure of a closed ring, which surrounds the receiving chamber (25) for the drone (1).

In some embodiments, the at least one flux-guiding element (23) has the structure of an open ring, wherein the receiving chamber is arranged in the open area of the ring structure.

In some embodiments, the at least one flux-guiding element (23) has at least one collector (29) in the area adjoining the receiving chamber (25).

In some embodiments, the sensor unit (41) comprises a sensor (43), which is embodied as a distance sensor and/or position sensor and/or magnetic sensor and/or force sensor.

As another example, some embodiments include a method for changing the temporary compensation for the magnetic field of a drone (1) for triggering mines by means of a device (21) as claimed in one of the preceding claims, which comprises the following steps: feeding an electric current into the electric coil device (31), through which a predetermined magnetic flux (39) is fed into the flux-guiding element, and inserting the drone (1) into the receiving chamber (25) or removing the drone (1) from the receiving chamber (25), In some embodiments, a method additionally comprises the following steps: measuring a physical characteristic, which depends on the relative position of flux-guiding element (23) and drone (1), by means of the sensor unit (41) during the insertion or removal, and regulating the current fed into the coil device (31) as a function of the measured value of the sensor unit (41) during the insertion or removal.

In some embodiments, the electric coil device (31) is operated so that the magnetic field (37) of the drone (1) is at least partly compensated for in the flux-guiding element (23).

In some embodiments, a method additionally comprises the step of transporting the magnetic compensation device (21) and the drone (1) together.

In some embodiments, an electric current is also fed into the coil device (31) during transport in order to compensate at least in part for the magnetic field (37) of the drone (1) in the flux-guiding element (23).

In some embodiments, the coil device (31) is not powered during transport.

In some embodiments, the measured physical characteristic is the distance and/or the spatial alignment between flux-guiding element (23) and drone (1).

In some embodiments, the measured physical characteristic is a magnetic flux density and/or a change in the magnetic flux density within the flux-guiding element (23) and/or in the area between drone (1) and flux-guiding element (23) and/or in the environment of the drone (1).

In some embodiments, the measured physical characteristic is the amplitude and/or direction of a force between flux-guiding element (23) and drone (1).

BRIEF DESCRIPTION OF THE DRAWINGS

The teachings herein are further developed below on the basis of a few example embodiments, which refer to the appended drawings, in which.

DETAILED DESCRIPTION

Figure 1:
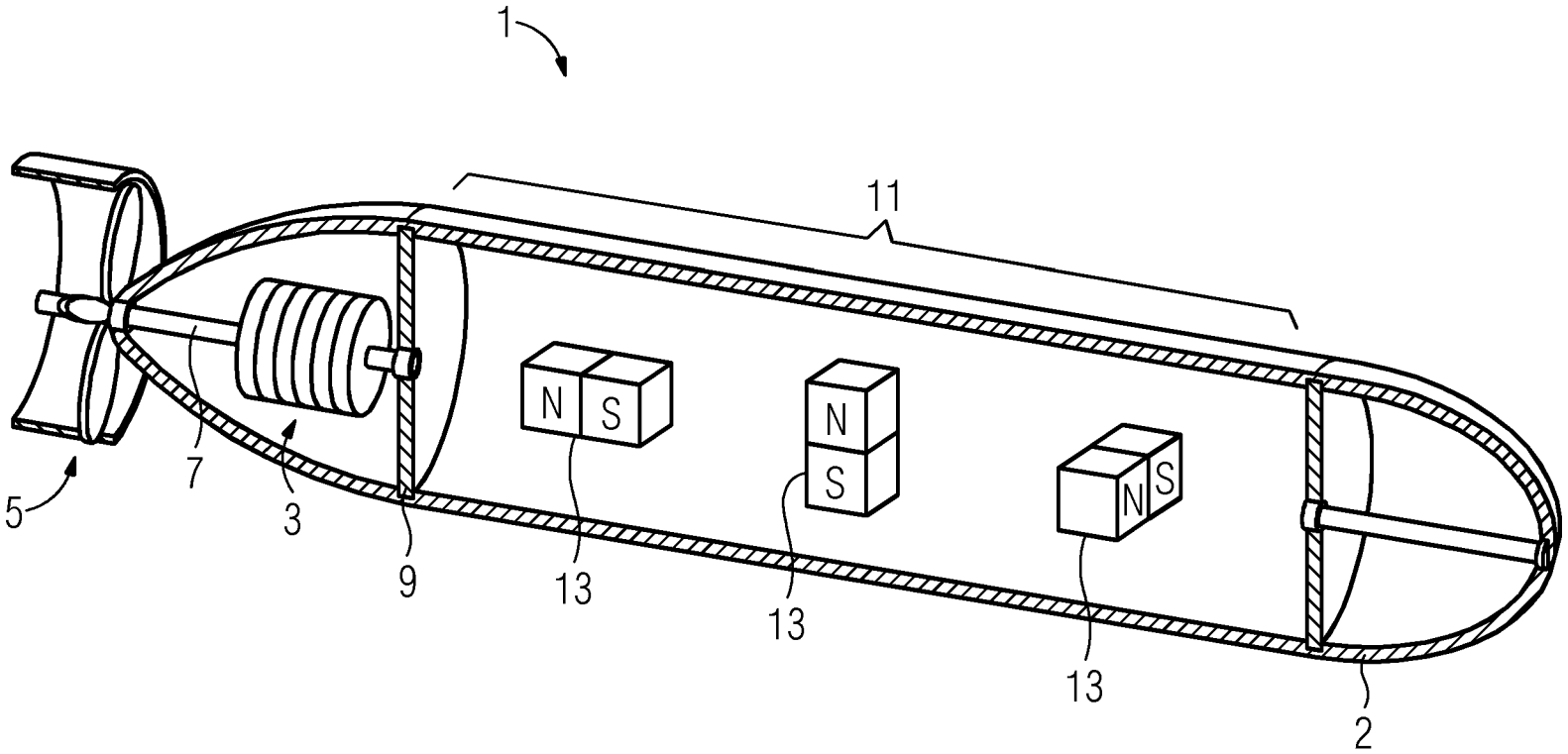
FIG. 1 shows a drone in a schematic longitudinal section.

In some embodiments, there is a compensation device designed to weigh as little as possible in order not to contribute too much to the transport weight. It should furthermore be as robust as possible and as simple as possible to use. In some embodiments, a method for changing the temporary compensation for the magnetic field of a drone uses such a device. In other words, this method may either enable such a temporary compensation to be brought about or enable an existing temporary compensation to be removed.

In some embodiments, a compensation device provides magnetic field compensation for a drone for mine clearance. In some embodiments, the device comprises at least one flux-guiding element made of a soft magnetic material, which has the structure of an open or closed ring. It further comprises a chamber for receiving the mine-clearance drone, in which said drone can be held, and in addition at least one electric coil device, which is coupled magnetically to the flux-guiding element in such a way that a predetermined magnetic flux can be coupled into the flux-guiding element with the coil device. In this case, the flux-guiding element and the receiving chamber are arranged in relation to one another so that a magnetic field brought about by the drone can be closed in the form of a ring in the flux-guiding element. The receiving chamber for the drone should not be understood here as a closed space, but in general terms as a place in the area of the compensation device in which the drone can be held. In some embodiments, the drone can be held in this receiving chamber so that it can be transported together with the compensation device.

The first-mentioned alternative of an "open ring" is to be understood in general terms here as a ring-shaped form that has a gap or an open side. Such a shape should in particular also be taken to include a U-shape.

In some embodiments, a compensation device provides a magnetic field that can be completed in the flux-guiding element in the form of a ring in such a way that the magnetic field of the drone is screened off from the external environment. In this case, either the drone to be inserted into the receiving chamber can be part of the completed magnetic field within the flux-guiding element (open ring variant) or the flux-guiding element encloses the drone to be inserted in a ring shape (closed ring variant).

The electric coil device present within the compensation device has the effect of not only allowing the magnetic field of the drone to be closed in the compensation device but also enabling it to be actively compensated for. In some embodiments, a magnetic flux can be coupled into the flux-guiding element with the coil device, which is set against the magnetic flux coupled in there by the drone. Such magnetic compensation does not have to be complete, but at least a part of the magnetic flux coupled in there by the drone can be compensated for within the flux-guiding element.

In any event the magnetic field of the drone will be effectively screened off from the outside by the flux-guiding element, so that transporting the drone is made possible by the far lower magnetic field effective in the external environment. In particular, such screening even allows transport by air to be made possible.

In some embodiments, a method serves to change the temporary compensation for the magnetic field of a drone for mine clearance by means of an inventive compensation device. An example method comprises:

Feeding an electric current into the electric coil device, by which a predetermined electric current is coupled into the flux-guiding element, and Inserting the drone into the receiving chamber or removing the drone from the receiving chamber.

In some embodiments, an electric current can be fed into the coil device in such a way that the predetermined magnetic flux coupled in hereby compensates in part for the magnetic flux caused by the drone in the flux-guiding element.

The change of temporary compensation described is to be understood in particular as either the drone being inserted into the receiving chamber in order to create a temporary compensation or the drone being taken out of the receiving chamber in order to remove an existing temporary compensation. In each case a relative movement of the drone relative to the receiving chamber should bring about a change in the magnetic compensation. Various embodiments of the compensation devices and of the methods described herein can be combined with one another.

In some embodiments, the compensation device comprises at least one sensor unit, by means of which a physical characteristic that depends on the relative position of flux-guiding element and drone can be measured. In addition, the device can then comprise at least one regulation device, by means of which a current fed into the electric coil winding can be regulated as a function of the measured size of the physical characteristic. In some embodiments, the insertion of the drone into the receiving chamber or its removal from said chamber (or in general terms a relative movement between drone and compensation device) is made significantly easier.

Without this type of measure the insertion or removal of the drone is associated with significant difficulties, since the high magnetic fields cause very high forces in the relative movement between drone and compensation device. Despite this, a high positioning accuracy must be achieved under the influence of these high forces, since only in a narrowly restricted range for the required position of the drone will an optimal compensation for the externally effective magnetic field be obtained. In order to resolve these difficulties, the drone can be inserted or removed in these embodiments during variable feeding-in of a magnetic compensation field by the coil device.

In particular the current fed in at a specific point in time in each case can be set so that the magnetic forces acting between device and drone are reduced or even minimized. In this case, the physical characteristic via which the relative position between drone and device is followed is not of any significance in principle. The only important factor is that at least a part of the information about this relative position is present through the measurement of the physical characteristic and thus the current in the coil device can be set in such a way that the relative movement between drone and device is facilitated.

In some embodiments, the flux-guiding element can have the structure of a closed ring that surrounds the receiving chamber for the drone. For example, the device can be embodied approximately symmetrically and in this way can be well adapted to the shape of the drone. Thus, the flux-guiding element can have a hollow-cylindrical basic form with a circular cross section and thus surround a circular cylinder-shaped drone with almost an exact fit. In some embodiments, the flux-guiding element can weigh comparatively little under some circumstances, since it can be embodied with a relatively small outlay in materials if it closely and symmetrically surrounds the drone. Since the drones in this embodiment variant can be surrounded so tightly by the flux-guiding element and since this element is in the form of a closed ring, the undesired stray flux is very small here. In some embodiments, barely any "slit radiation" escapes.

In some embodiments, the flux-guiding element can also have the structure of an open ring, wherein the receiving chamber is arranged in the open area of the ring structure. In particular the receiving chamber can thus be arranged in the area of the open side of an approximately u-shaped structure. In some embodiments, the receiving chamber here is not surrounded on all sides and is thus more easily accessible, in order to enable the drone to be guided more precisely as it is being inserted or removed for example. Likewise, one side of the flux-guiding element facing away from the drone is available here, which is particularly easily accessible here for the fitting of the electric coil device.

Under some circumstances in this form of embodiment the flux-guiding element can also be designed in a manner that especially saves on materials and thus makes it very light, so that the drone does not have to be surrounded on all sides by the light magnetic material. In some embodiments, the electric coil for coupling in the compensation field can be arranged in an area of the ring away from the drone.

In general the flux-guiding element can have a collector, but in some cases, two collectors, in the area adjoining the receiving chamber. Such a collector is to be understood as a structure that facilitates the collection and bundling in the flux-guiding element of the magnetic flux emitted by the drone. In particular, these types of collectors can be embodied as types of magnetic pole shoes. They can thus have an especially high contact surface (or magnetic interaction surface, if there is no direct mechanical contact) in the area of the drone. Such an "interaction surface" can in particular be far greater than the cross section of the flux-guiding element in the other areas lying further away from the drone. In some embodiments, a large part of the magnetic flux emanating from the drone is bundled in the flux-guiding element and thus stray flux is reduced in the area of the compensation device. The embodiment of the flux-guiding element with at least one collector may be effective with an open ring.

The sensor unit for measuring a position-dependent physical characteristic can be embodied in different ways. In some embodiments, the sensor unit can generally comprise a distance sensor. This can involve a distance sensor that is based on an optical measurement of distance for example. This term is basically intended to include an infrared-based measurement. As an alternative the sensor unit can comprise a position sensor—in particular an optical position sensor, which as well as the pure distance of the two relevant objects from one another, can also determine their rotational alignment in relation to each other for example.

In some embodiments, the sensor unit can include a magnetic sensor. The sensor can be embodied for example to measure the magnetic flux density and/or the change in the magnetic flux density within the flux-guiding element or between flux-guiding element and drone. In some embodiments, the magnetic sensor can also be designed to measure the stray magnetic flux in the environment of the compensation device. The magnetic sensor can involve a Hall sensor for example.

In some embodiments, the sensor unit can comprise a force sensor. Such a force sensor can be used to measure the amplitude and/or direction of a force acting between drone and flux-guiding element for example. In some embodiments, the sensor unit can also comprise various different possible combinations of the types of sensor described above.

In some embodiments, there are one or more spacers between the flux-guiding element and the receiving chamber, which may be embodied from non-magnetic material. These types of spacer can serve to make possible a more precise positioning between drone and flux-guiding element and/or to hold the drone in its required position once it has been positioned. The non-magnetic embodiment of the spacers may be suitable, since otherwise the magnetic forces between drone and the device can become so large that the drone and the compensation device can barely still be moved relative to one another. In some embodiments, the width of the gap between the drone to be arranged in the receiving chamber and the soft magnetic parts of the device (i.e. the flux-guiding element) can lie in a range between 0.1 cm and 10 cm. In this range of gap widths a good guidance of the magnetic flux and despite this a good positioning of the drone (at least when a compensation field is fed in via the coil device) can be achieved at the same time.

The soft magnetic material of the flux-guiding element can have a magnetic permeability number of at least 300, in particular at least 1000 or even at least 3000. In some embodiments, the soft magnetic material can comprise iron, cobalt and/or nickel and/or alloys with the said metals. In some embodiments, the main component can be one of the said metals. These types of soft magnetic material, along with the flux-guiding element, are also especially suitable for collecting and closing into a ring shape a high magnetic flux of the drone, with a comparatively small magnetic stray field in the external environment.

In some embodiments, the flux-guiding element can be composed of a number of separate individual elements. This type of multi-part design can make the insertion of the drone into the compensation device or its removal therefrom significantly easier. In some embodiments, the flux-guiding element can have a joint or a hinge (or even several of them). In some embodiments with an open ring, the joint or the hinge the gap in the ring can be further enlarged temporarily in order to receive the drone. After the joint or the hinge is closed the flux-guiding element can surround the drone relatively tightly.

In some embodiments, the compensation device and/or the method for compensation can be embodied so that even without the feeding in of a compensation field by the coil device, the magnetic flux present outside the device does not exceed a value of 500 μT (in some cases, just 100 μT). In some embodiments, a drone may operate in a setting where the uncompensated magnetic field in an area outside the drone has a magnetic flux of 100 mT or more.

In the method for magnetic field compensation and its embodiment variants described below the sequence of steps given is not fixed to the specified sequence. In some embodiments, the sequence can also be reversed and/or the steps can be carried out simultaneously and/or a number of steps of the same type can be carried out alternately one after the other.

In some embodiments, the method can additionally comprise the following steps:

Measurement of a physical characteristic, which depends on the relative position of flux-guiding element and drone, by means of the sensor unit during the insertion or removal, Regulation of the current fed into the coil device as a function of the measured value of the sensor unit during the insertion or removal.

The sequence of the steps "measurement of the characteristic", "movement of the drone" and "regulation of the current" is not fixed to the sequence specified. In some embodiments, the sequence can also be reversed and/or the steps can be carried out simultaneously and/or a number of steps of the same type can be carried out alternately one after the other. In particular, the insertion or removal of the drone will be especially facilitated if the steps of measurement, movement and regulation are either carried out simultaneously or iteratively in a plurality of consecutive steps.

In some embodiments, the drone, which is inserted into the compensation device or removed from it, can have a magnet device with at least one permanent magnet. The effect of the compensation device may be more pronounced in conjunction with permanent magnets, since with these types of drone the magnetic field cannot be simply switched off without such a device, transport especially by air is not readily possible. It is however not out of the question for the drone, as an alternative or in addition, to have a magnet device with at least one electromagnetic coil for creating a magnetic field. In such cases a superconducting coil in particular can be involved, which can be operated in a quasi-persistent mode for example. With coils of this type it can also be advantageous not to interrupt the flow of current for transport and despite this to compensate for the magnetic field with the device described.

In some embodiments, the electric coil device can be operated so that the magnetic field of the drone is compensated for at least in part in the flux-guiding element. In other words, the coil device can be operated so that a magnetic flux coupled by it into the flux-guiding element is in opposition to the magnetic flux coupled in there by the drone. Such a compensation does not have to be complete however, but rather a part compensation is sufficient for this form of embodiment, i.e. the presence of flux contributions with different leading signs. In some embodiments, the coil device is operated so that the magnetic flux of the drone is at least 10% compensated for in the flux-guiding element. In some embodiments, the magnetic flux can be at least 50% compensated for.

In some embodiments, a method can additionally comprise the step of joint transport of magnetic compensation device and drone. Here the advantages can come into play especially effectively, since such transport is often not possible without this compensation. In some embodiments, the transport involves transport by an aircraft.

In some embodiments, which also includes the transport, an electric current is also fed into the coil device during transport, in order to compensate at least partly for the magnetic field of the drone in the flux-guiding element. In such variants, an additional compensation for the magnetic field of the drone is also available during transport, which goes beyond the pure closure into a ring of the magnetic flux in the flux-guiding element. Thus, the residual magnetic field in the environment of the compensation device equipped with the drone can be reduced especially effectively.

In some embodiments, the coil device may not be powered during transport—then no additional power supply facility for the coil device is needed during transport and the weight of said device is saved accordingly. Furthermore, during transport by air, the operation of the electric coil device could lead to additional interference, which is avoided with this variant. Thus, with this variant the coil device only has power applied to it so as to compensate for the drone's magnetic field when it is being inserted or removed. During transport it is then sufficient for the magnetic field of the drone to be closed in a ring shape through the flux guidance in the flux-guiding element and through this for no large proportions of the field to get into the external environment of the compensation device. In particular the magnetic flux in the environment outside the compensation device can also be limited with this variant to <100 μT.

In some embodiments, the measured physical characteristic can also advantageously be the distance and/or the spatial alignment between flux-guiding element and drone. In some embodiments, the measured physical characteristic can be a magnetic flux density and/or a change in the magnetic flux density within the flux-guiding element and/or in the area between drone and flux-guiding element and/or in the environment of the drone. In some embodiments, the measured physical characteristic can be the amplitude and/or direction of a force between flux-guiding element and drone.

The advantages associated with these individual variants correspond to the advantages of the analogous forms of embodiment of the device.

Shown in FIG. 1 is an individual drone 1 for triggering mines in a longitudinal section, as can be employed in the examples of the compensation device given below. The figure shows an elongated shape of drone 1 with an outer housing 2 that is designed to travel underwater. In its rear part (shown on the left in the drawing) it has a propeller 5, which can be driven by an electric motor 3 via a rotor shaft 7. These three elements 3, 5 and 7 thus together form a propulsion unit here. The electric motor 3 is separated by a partition wall 9 from the area of the drone 1 which contains the magnet device 11 for magnetic triggering of mines. Furthermore, an energy store not shown here, in the form of a battery for example, can be present inside the drone. The electric motor 3 can also be supplied with energy via an electric cable not shown here however. Other drive variants are likewise conceivable, for example with an internal combustion engine to drive the drone or with an additional generator, which delivers the electrical energy for the electric motor. In some embodiments, the drone can also be towed by a cable for example. In such an alternate form of embodiment there can be a generator for example in the area provided in FIG. 1 for the propulsion unit, with which magnetic coils also optionally present can be supplied with electrical energy.

In the drone depicted in FIG. 1, the magnet device 11 comprises three separate permanent magnets 13, of which the spatial alignment is different, so that magnetic fields with different alignments are created. In principle it is sufficient, however, for only one such permanent magnet 13 to be present, in order to create a magnetic field sufficiently strong to trigger mines outside the drone. The three different permanent magnets 13 are thus only to be understood as being by way of example here for the different alignments. However basically, as is shown here, a combination of a number of such magnets can also be present. Or the permanent magnets can be replaced in part or entirely by magnetic coils.

Figure 2:
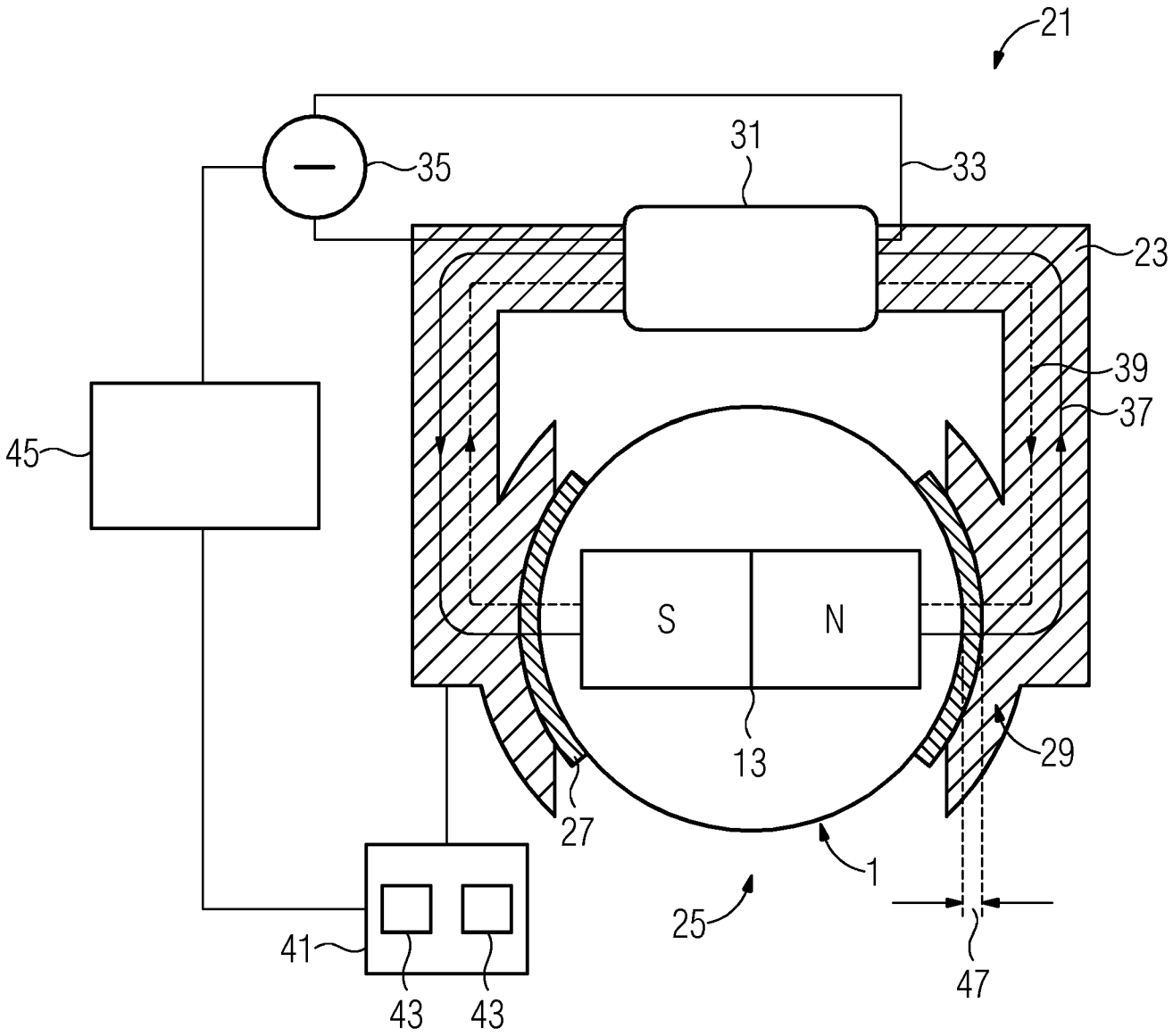
FIG. 2 shows a compensation device according to a first example embodiment incorporating teachings of the present disclosure with a drone inserted into it in a schematic cross section.

FIG. 2 shows a compensation device 21 according to a first embodiment in a schematic cross section, i.e. transverse to the main direction of the drone to be inserted. This compensation device 21 has a receiving chamber 25, into which a drone 1 with a permanent magnet 13 inside it is already inserted. This permanent magnet 13 is oriented here so that the strongest magnetic flux in relation to the longitudinal axis of the drone is aligned in the radial direction. The compensation device 21 has a flux-guiding element 23, which is embodied here as a U-shaped iron yoke. The receiving chamber 25 for the drone is formed here by the open side of the U shape. When the drone 1 as shown here is inserted into this receiving chamber and aligned accordingly with the direction of the permanent magnet 13 lying inside, the magnetic flux 37 caused by the drone can be closed within the flux-guiding element 23 as shown. The drone itself thus closes the open part of the ring of the flux-guiding element. Through the closure of the magnetic flux 37 within the flux-guiding element 23 a large part of the magnetic flux is already screened off from the outside.

The compensation device 21 has a coil device 31, which is arranged around one side of the flux-guiding element 23. By means of a power source 35, an electric current can be fed into this coil device 31 via a separate circuit 33, so that a further magnetic field is created by the coil device 31. Through this an additional magnetic flux 39 is coupled into the flux-guiding element 23. This magnetic flux 39 is opposed to the magnetic flux 37 brought about by the drone, as is indicated by the direction of the arrows. The magnetic flux brought about by the coil device 31 in this example is smaller than the magnetic flux 39 brought about by the drone, which is intended to be shown by the dashed line. Thus only a part compensation of the magnetic flux flowing within the element 23 is involved here. The strength of this part compensation can be varied however. To this end the compensation device 21 is equipped with a sensor unit 41, which has one or more sensors 43. Two such sensors are shown in FIG. 2 by way of example. These sensors can involve different kinds of sensors, as described in general terms above. For example, a combination of an optical sensor and a force sensor can be present here, wherein the force sensor measures the magnetic force acting between the drone and the compensation device. The sensor device 41 (regardless of the precise embodiment of the sensor or of the sensors) is connected to the regulation device 45, via which the current fed into the coil device 31 by means of the power source 35 can be varied.

Through this the magnetic flux proportion 39 is thus also varied, i.e. the degree of magnetic compensation. Depending on the signal measured by the sensor unit 41—i.e. depending on the current position of the drone relative to the compensation device—the magnetic forces acting at that moment are thus influenced. This makes it significantly easier to insert the drone into the receiving chamber or remove it from said chamber respectively.

In order to position the drone as precisely as possible at the desired location in the receiving chamber and be able to fix it there as well as possible, two spacer elements 27, which are made of non-magnetic material, may be introduced in the example shown between the drone 1 and the flux-guiding element 23. Through these spacers a gap 47 with no magnetic effect is formed between the drone and the flux-guiding element, which can have a width of 1 cm for example.

In order to collect the magnetic flux embodied by this permanent magnet 13 as well as possible and be able to bundle it in the flux-guiding element, the flux-guiding element 23 is equipped here with two collectors 29, which rest with a widened contact surface (wherein the contact is realized here indirectly via the spacers 27) on the drone 1. In this way magnetic stray fields can be effectively reduced. In order to be able to move the drone more easily into the receiving chamber 25 or take it out of said chamber, optionally a guide not shown here can be present. For example, the drone can be moved via a rail system to the desired location in the receiving chamber 25.

Figure 3:
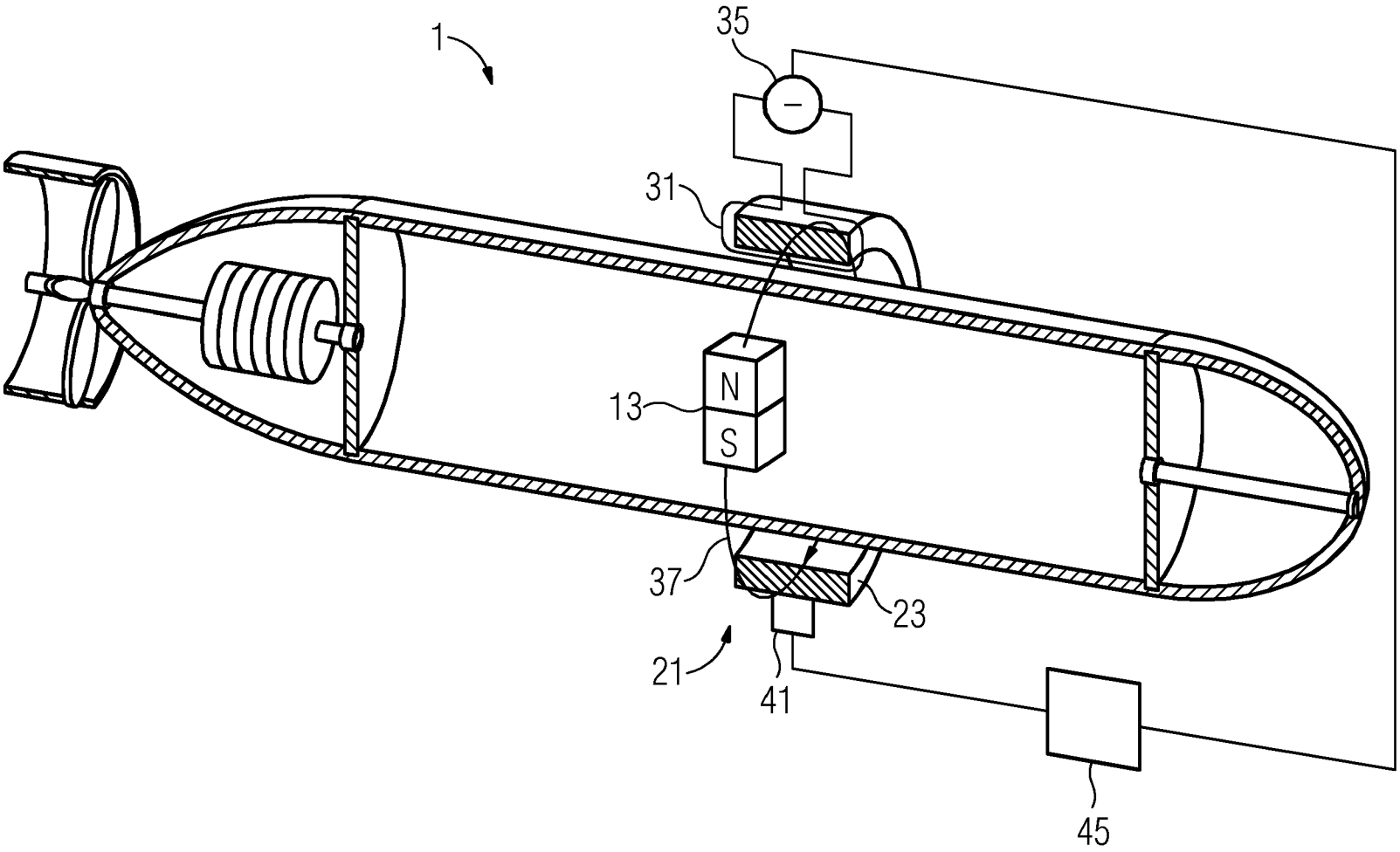
FIG. 3 shows a compensation device according to a second example embodiment incorporating teachings of the present disclosure with a drone inserted into it in a schematic longitudinal section.

FIG. 3 shows a compensation device 21 according to a second embodiment in a schematic longitudinal section, likewise with a drone 1 inserted into the receiving chamber provided for it. The compensation device 21 of this example has a flux-guiding element 23, which forms a closed ring here and is embodied in a circular cylindrical shape. In a similar way to that depicted in FIG. 1 a schematic half section is shown here, so that only the rear half of the cylindrical flux-guiding element 23 is also shown here. Overall the flux-guiding element 23 surrounds the drone 1 in the form of a ring however. The element 23 surrounds the drone 1 in an area within which a permanent magnet 13 is once again arranged so that its magnetic axis is oriented in a radial direction. The magnetic axis is understood here as the axis that connects the magnetic north pole N and the magnetic south pole S to one another. The main direction of the strongest magnetic flux outside of the permanent magnet 13 is thus aligned here essentially upwards and downwards, as is indicated by the field line 37. This magnetic flux 37 brought about by the drone can be closed within the two halves of the flux-guiding element 23, as shown here schematically for the bottom half. Thus in this arrangement too an escape of stray flux into the external environment of the compensation device 21 is largely avoided. In a similar way to the field line 37 shown here, the magnetic flux can also be closed in the front half of the circular cylindrical element 23 not shown here.

In order to be able to compensate at least in part for the magnetic flux within the element 23 an electric coil device 31 is also routed here around a part area of the flux-guiding element. Only one such coil device is shown here by way of example. This is sufficient to at least bring about a proportional field compensation in the rear half. Basically however there can also be one or more further such coil devices present, in order for example also to bring about a flux compensation in the front half not shown. The position of the coil device 31 shown only involves an example of an embodiment, in order to enable the coil device to be visualized.

In principle however the location can also be provided at another point on the circumference of the cylindrical element 23, for example further back in an area of the magnetic flux being closed in the form of a ring, which area is facing away from the permanent magnet 13. For the sake of clarity, the magnetic flux, which is coupled here by the coil device 31 into the flux-guiding element 23, is not shown. In a similar way to FIG. 2 however this magnetic flux set in opposition to the magnetic flux 37 brought about by the drone should compensate for it at least in part.

In embodiments with a flux-guiding element closed in the shape of a ring the device may have at least two coil devices, which surround the flux-guiding element at different points on its circumference. In this way the magnetic field of the drone can be closed in two branches in the flux-guiding element and the magnetic field can be compensated for in these two branches in each case by the coil devices assigned to each of these branches.

In a similar way to the embodiment depicted in FIG. 2 the compensation device 21 also comprises an arrangement consisting of a sensor unit 41 here, with which the relative position of the drone in relation to the compensation device or at least a position-dependent physical characteristic can be monitored, and a regulation device 45, with which a current flowing through the coil device can be regulated as a function of the position.

Figure 4:
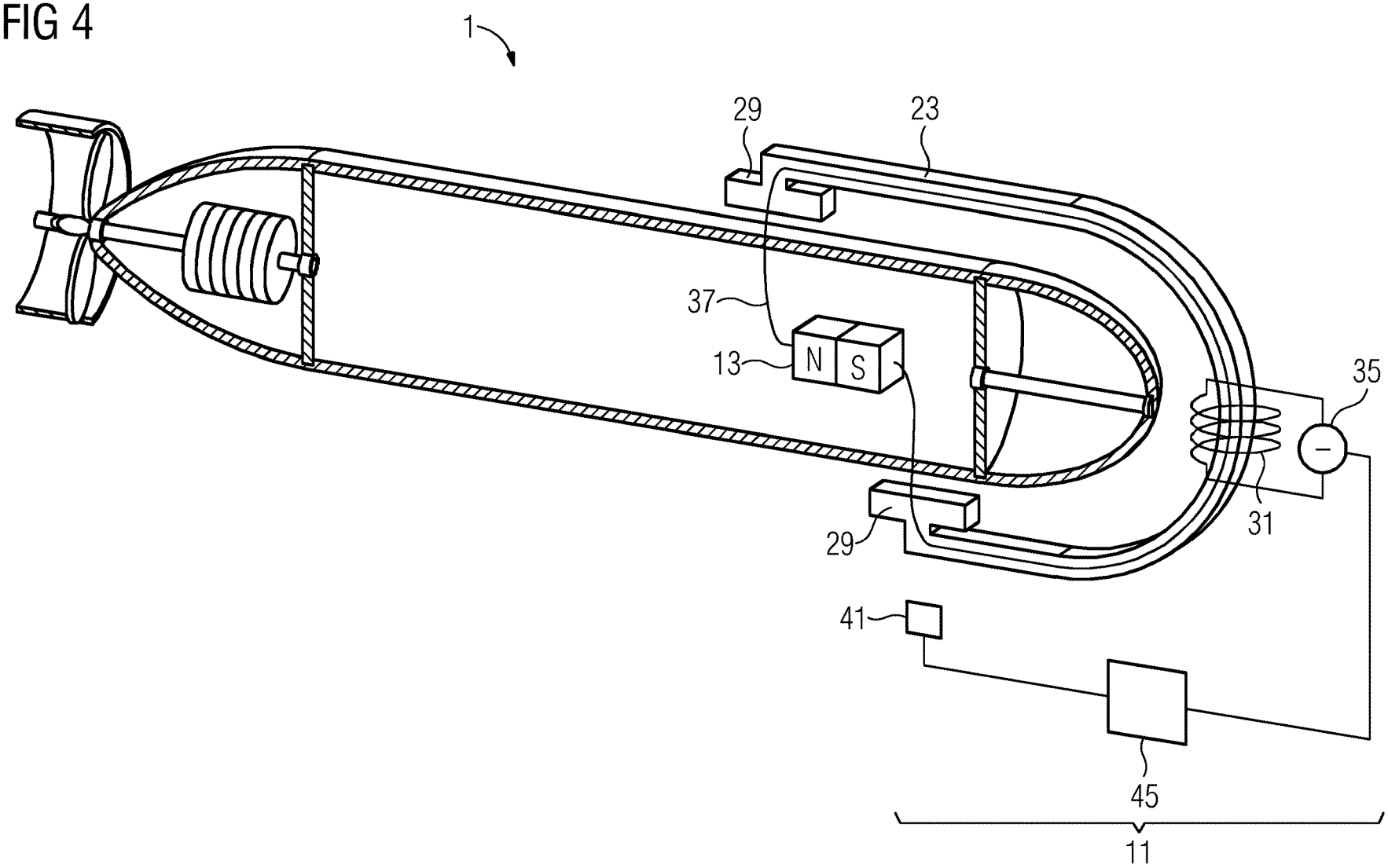
FIG. 4 shows a compensation device according to a third example embodiment incorporating teachings of the present disclosure with a drone inserted into it in a schematic longitudinal section.

FIG. 4 shows a compensation device according to a further embodiment, likewise in a schematic longitudinal section and with a drone 1 inserted. In this exemplary embodiment, the compensation device 21 has a flux-guiding element 23, which is embodied as an open ring in the shape of a U. Here too the drone 1 is arranged in the area of the open side of this U shape, so that the magnetic flux can be closed in the form of a ring between drone and flux-guiding element 23. Here too the drone 1 has a single permanent magnet 13, of which the main magnetic axis, by contrast with the previous examples, is aligned not radially but axially. In order to be able to close the magnetic flux formed by this permanent magnet 13 in the form of a ring, the flux-guiding element 23 is embodied here so that it can collect the magnetic flux in the area of the drone lying radially to the outside with two collectors 29 that are offset in the axial direction. This closure can be closed via the other part of the flux-guiding element 23 in a ring shape, as is indicated in FIG. 4 by means of the representative field line 37. In the example depicted in FIG. 4 the flux-guiding element is formed so that the central area of the U shape surrounds the drone 1 in its axial end. As an alternative to this embodiment however, there may be a flux-guiding element with similarly axially slightly offset collectors, of which the central side is closed not in the axial end area but lying axially inwards via the circumference of the drone.

A coil device 31 is once again also provided in the example depicted in FIG. 4, by means of which a magnetic flux to compensate for the magnetic field of the drone can be coupled into the flux-guiding element 23. To regulate the current in the coil device 31 a sensor device 41 and also a regulation device 45 are also present here.

In the examples of FIGS. 2, 3 and 4 only one permanent magnet 13 is shown in the interior of the drone 1 in each case. In some embodiments, a number of such permanent magnets can be present inside a drone in each case, wherein then, to compensate for and/or to screen off the magnetic field formed, either a number of separate compensation devices 23 or also a higher-ranking compensation device can be present. For example, a compensation device with a cylindrical flux-guiding element 23, similar to that shown in FIG. 3, can also be provided for magnetic compensation for a number of radially-aligned permanent magnets. A compensation device for magnetic compensation for a number of permanent magnets (in particular aligned differently) can also have a number of flux-guiding elements in the form of open and closed ring structures.

What is claimed is:

1. A magnetic compensation device for a drone for triggering mines, the device comprising:

a flux-guiding element comprising a magnetic material in the shape of an open or closed ring;

a receiving chamber for the drone for holding the drone; and an electric coil device coupled magnetically to the flux-guiding element so a predetermined magnetic flux can be coupled into the flux-guiding element using the coil device;

wherein the flux-guiding element and the receiving chamber are arranged in relation to one another so that a magnetic flux brought about by the drone can be closed through the ring shape of the flux-guiding element; and wherein the flux-guiding element comprises an open ring, and the receiving chamber is disposed within an open area of the ring structure.

2. The device as claimed in claim 1, further comprising:

a sensor unit testing a physical characteristic corresponding to a position of the flux-guiding element relative to the drone; and a regulator controlling a current fed into the electric coil device based on a function of the physical characteristic.

3. The device as claimed in claim 1, wherein the flux-guiding element comprises a closed ring surrounding the receiving chamber for the drone.

4. The device as claimed in claim 1, wherein the flux-guiding element includes a collector adjoining the receiving chamber.

5. The device as claimed in claim 1, wherein the sensor comprises at least one sensor selected from the group consisting of: a distance sensor, a position sensor, a magnetic sensor, and a force sensor.

6. A method for providing temporary compensation for a magnetic field of a drone for triggering mines, the method comprising:

feeding an electric current into an electric coil device;

using the electric current, generating a predetermined magnetic flux in a flux-guiding element;

inserting the drone into a receiving chamber or removing the drone from the receiving chamber;

measuring a physical characteristic representing a relative position of the flux-guiding element with respect to the drone, using a sensor unit during the insertion or removal; and regulating the current fed into the coil device as a function of the measured value of the sensor unit during the insertion or removal;

wherein the measured physical characteristic represents an amplitude and/or direction of a force between flux-guiding element and drone.

7. The method as claimed in claim 6, further comprising operating the electric coil device so that the magnetic field of the drone is at least partly compensated for in the flux-guiding element.

8. The method as claimed in claim 6, further comprising transporting the magnetic compensation device and the drone together.

9. The method as claimed in claim 8, further comprising feeding an electric current into the coil device during transport to compensate at least in part for the magnetic field of the drone in the flux-guiding element.

10. The method as claimed in claim 8, wherein the coil device is not powered during transport.

11. The method as claimed in claim 6, wherein the measured physical characteristic represents a distance and/or the spatial alignment between flux-guiding element and drone.

12. The method as claimed in claim 6, wherein the measured physical characteristic represents at least one parameter selected from the group consisting of: a magnetic flux density, and a change in the magnetic flux density within the flux-guiding element and/or in the area between drone and flux-guiding element and/or in the environment of the drone.

13. A magnetic compensation device for a drone for triggering mines, the device comprising:

a flux-guiding element comprising a magnetic material in the shape of an open or closed ring;

a receiving chamber for the drone for holding the drone; and an electric coil device coupled magnetically to the flux-guiding element so a predetermined magnetic flux can be coupled into the flux-guiding element using the coil device;

wherein the flux-guiding element and the receiving chamber are arranged in relation to one another so that a magnetic flux brought about by the drone can be closed through the ring shape of the flux-guiding element; and wherein the flux-guiding element includes a collector adjoining the receiving chamber.

14. The device as claimed in claim 13, further comprising:

a sensor unit testing a physical characteristic corresponding to a position of the flux-guiding element relative to the drone; and a regulator controlling a current fed into the electric coil device based on a function of the physical characteristic.

15. The device as claimed in claim 13, wherein the flux-guiding element comprises a closed ring surrounding the receiving chamber for the drone.

16. The device as claimed in claim 13, wherein the flux-guiding element comprises an open ring, and the receiving chamber is disposed within an open area of the ring structure.

17. The device as claimed in claim 13, wherein the sensor comprises at least one sensor selected from the group consisting of: a distance sensor, a position sensor, a magnetic sensor, and a force sensor.

* * * * *